US005679195A

United States Patent [19]

O'Dwyer et al.

[11] Patent Number: 5,679,195

[45] Date of Patent: Oct. 21, 1997

[54] WEB SPLICING APPARATUS

[75] Inventors: John O'Dwyer, Lynn, Mass.; Richard Sangster, Greenville, R.I.; Gary O'Brien, Rockland, Mass.

[73] Assignee: John O'Dwyer, Lynn, Mass.

[21] Appl. No.: 522,947

[22] Filed: Sep. 1, 1995

[51] Int. Cl.[6] ..... B65H 69/06

[52] U.S. Cl. ..... 156/159; 156/304.3; 156/504; 156/505; 156/507; 242/553; 242/554.6; 242/556

[58] Field of Search ..... 156/157, 159, 156/304.1, 304.3, 502, 504, 505, 507; 242/552, 553, 554, 554.1, 554.5, 554.6, 556

[56] References Cited

U.S. PATENT DOCUMENTS

| | | | |
|---|---|---|---|
| 2,844,186 | 7/1958 | Sunnen, Jr. | 156/507 |
| 3,089,661 | 5/1963 | Phillips, Jr. et al. | 242/554.6 X |
| 3,227,594 | 1/1966 | Ryan | 156/507 X |
| 3,305,189 | 2/1967 | Butler, Jr. et al. | 242/58.1 |
| 3,414,208 | 12/1968 | Butler, Jr. et al. | 242/58.1 |
| 3,858,819 | 1/1975 | Butler, Jr. | 242/58.3 |
| 4,121,964 | 10/1978 | Berkowitz et al. | 156/507 |
| 4,222,533 | 9/1980 | Pongracz | 156/502 X |
| 5,045,134 | 9/1991 | Schenker et al. | 156/157 X |
| 5,190,234 | 3/1993 | Ezekiel | 156/157 X |
| 5,253,819 | 10/1993 | Butler, Jr. | 242/58.3 |

FOREIGN PATENT DOCUMENTS

| | | | |
|---|---|---|---|
| 61-27860 | 2/1986 | Japan | 156/502 |
| 62-21656 | 1/1987 | Japan | 242/552 |
| WO 91/16255 | 10/1991 | WIPO | 242/552 |

*Primary Examiner*—Mark A. Osele
*Attorney, Agent, or Firm*—Kenway & Crowley

[57] ABSTRACT

An input festoon is provided in a web supply apparatus for automatically splicing a relatively stiff web of material such a liner board for making corrugated board. The input festoon includes a dancer roll which is movable along a track to allow storage of a ready web as the ready web is pre-accelerated by an accelerator roll to a running speed prior to creation of a splice at a splice head. Tail grab sensors are mounted on the apparatus above the web between the input roll and the splice head adjacent the input roll. The tail grab sensor detects tears or breaks in the web and provides an electrical signal to initiate a splice. A vacuum box including a pivotable vacuum bar is provided for creating a high speed butt splice. A method of creating a high speed butt splice using the vacuum box is also presented.

4 Claims, 4 Drawing Sheets

WEB SPLICING APPARATUS

FIELD OF THE INVENTION

The present invention relates to a web splicing apparatus, and, more particularly, to an apparatus which automatically splices and cuts relatively stiff web material such as liner board for making corrugated board.

BACKGROUND OF THE INVENTION

Web supply apparatus is designed particularly to splice the leading edge of a ready web of stiff material to the trailing edge of a running web while the web proceeds uninterruptedly at substantially uniform speed and tension to a web-consuming machine, e.g. a corrugator, printer, etc. Such machines are, of course, not new. Examples of these machines are shown in U.S. Pat. Nos. 3,305,189, 3,414,208, and 3,858,819.

As shown particularly in U.S. Pat No. 3,858,819, prior art machines generally comprise two main structural components; a splice head, and an output festoon. The web supply apparatus delivers web, such as liner board for making corrugated board, from one of two rolls one of which is running and one of which is at the ready. The web from the running roll travels through the splice head which is located more or less above and between the two rolls. From there, the web travels to the output festoon or accumulator which is positioned in a generally horizontal plane directly above the two rolls and the splice head and thence to the web-consuming machine.

While web from the running roll is being consumed, the leading edge of the ready roll is prepared by securing it to a mounting bar by means of a suitable adhesive or the like and applying a strip of double-faced adhesive to the edge. Then, the mounting bar is carried to the splice head, either automatically or manually, to await depletion of the running roll.

When the running roll reaches a predetermined minimum diameter, the splicing cycle commences. First, the roll of running web is braked to a smooth stop. As soon as the rolls stops, a pair of spaced-apart opposed pressure pads at the splice head are projected toward each other. One pad extends directly behind the mounting bar holding the leading edge of the ready web. The other pad is located behind the running web passing through the splice head. As the two pads are urged toward one another, the running web and ready web are pressed together and adhere by virtue of the double-faced, pressure-sensitive tape on the ready web. A knife is associated with each pressure pad at the splice head, each knife extending the full width of the web. The knife associated with the pad behind the running web is actuated immediately following the splice so that it is propelled through the running web, thereby completely severing the web.

All during the splicing operation, the web supply apparatus still delivers web at constant speed and tension to the web-consuming machine, drawing on the supply of web stored in the festoon. As soon as the expiring end of the running web is severed as aforesaid, the roll of ready web is accelerated until the festoon is refilled with the web from the new roll, thereby completing the splice cycle.

While prior art machines function fairly well at low output speeds, e.g. under 750 f.p.m., output speed is limited by the amount of web stored in the output festoon and the ability of the machine to accelerate the ready web to a running speed. Acceleration of the ready web, however, is constrained by the size of the ready roll which can approach 8000 lbs. To accelerate this roll to a high running speed, e.g. 1200 f.p.m., after a splice would require an extremely powerful drive system. Moreover, even if a drive system capable of sufficiently accelerating the roll were provided, the initial tension on the web would certainly break the web.

Accordingly, in an effort to provide increased output speed, the prior art has attempted to increase web storage in the output festoon by providing additional dancer rolls. In theory, increased web storage provides additional time for accelerating the ready roll after a splice since the stored web is fed to the corrugator during acceleration of the roll. Practically, however, providing additional dancer rolls has not allowed significant increases in output speed.

This is primarily because the overall length of the output festoon is restricted by the available space on the corrugator for placement of a splicer. Generally, web splicers are required to fit within a length of the corrugator bridge of about 202". Thus, as additional dancer rolls are introduced into the output festoon, valuable space within the festoon is occupied by the dancer rolls themselves. As additional dancer rolls are provided, the amount of additional web storage allowed by the additional rolls decreases. Accordingly, the output speed of prior art splicers has been limited to about 1000 f.p.m. due primarily to space restrictions inherent with corrugator lines.

In addition, at high output speeds prior art web splicers suffer serious disadvantages when there is a breakage in the running web. This is because prior art machines are generally designed to initiate a splice only when the running roll expires to a predetermined minimum diameter. They are, however, incapable of reliably creating a splice when a running web inadvertently breaks during operation or expires from the running. Such a splice is known as a "tail grab" splice.

To effect a "tail-grab" splice, sensors must detect a break or interruption in the running web and initiate a splice before the tail of the running web-passes through the splice head. At high speeds, however, a running web tail passes through the splice head long before the splice can be initiated. Thus, significant downtime is required for the entire web consuming machine.

Another disadvantage of prior art web splicers, lies in their inability to create an accurate butt splice joint over a large range of output speeds. Prior art web splicers are generally adapted to create a lap joint between the running web and the ready web. To create the lap joint, an operator attaches double faced adhesive tape to the leading edge of the ready web which is positioned within the splice head by a carrying bar. When the splice head fires to make the joint, the adhesive adheres the ready web to the running web and the running web is severed behind the splice. Thus, several inches of unglued running web extends beyond the splice. This "tail" of unglued running web ultimately causes difficulties when finished corrugated board stock is automatically cut and stacked by the corrugator. As sheets of finished stock are stacked, an unglued "tail" can catch a following sheet thereby causing sheet to slide under the tail and jamming the cutting and stacking machinery.

Accordingly, there is a need in the art for a web supply apparatus capable of operating at high output speeds, and at the same time having the ability to create a tail-grab splice. In addition, there is a need in the art for a web supply apparatus capable of producing a high speed butt splice to obviate the disadvantages associated with prior art overlap splices.

OBJECTS OF THE INVENTION

Thus, it is an object of the present invention to provide a web supply apparatus which is capable of providing web to a web-consuming apparatus at high output speeds.

Another object of the present invention to provide a web supply apparatus which is capable of creating a high speed tail grab splice.

Yet another object of the present invention is to provide a web supply apparatus capable of creating a butt splice between the running web and the ready web.

These and other objects of the present invention will become apparent from a review of the description provided below.

SUMMARY OF THE INVENTION

The present invention provides a web supply apparatus capable of creating high speed splices between a ready web and a running web using an input festoon. The input festoon stores an amount of ready web sourced from a ready roll while a splice is being made in the splice head. The input festoon thereby allows the ready roll to be pre-accelerated to a running speed before the splice is made. Preferably, the input festoon includes a dancer roll around which the ready web is trained. The dancer roll is movable along a track to store the ready web while the splice is being created.

In a preferred embodiment, the web supply apparatus also includes an input roll spaced from the splice head toward an end of the apparatus adjacent the ready roll. The input roll allows a tail grab sensor to be fixed to the apparatus within about 6 inches from the running web for detecting tears in the running web and initiating a tail grab splice. Preferably, the input roll provides for about 10 feet of running web to be stored between the input roll and the splice head. With this storage, a tail grab splice can be effectively initiated before a ruptured end of the running web passes through the splice head.

In further preferred embodiment, a vacuum box is provided to facilitate creation of high speed butt splices. The vacuum box includes first and second adjacent vacuum bars which hold the ready web by force of suction. One of the vacuum bars includes a lengthwise slot for severing the ready web and creating a leading edge of ready web which extends over the second vacuum bar and onto the first. The second vacuum bar is pivotable about a pivot point to separate the leading edge of the ready web from first vacuum bar, and is further pivotable about the pivot point to return the leading edge onto first vacuum bar.

A method of using the vacuum box to prepare a ready web for high speed butt splicing includes placing the ready web on the first and second vacuum bars and cutting the ready web in line with the slot to create the leading edge of running web on a portion of the first vacuum bar. The second vacuum bar is then pivoted to remove the leading edge from the first vacuum bar, and an adhesive tape is placed on the first vacuum bar. The second vacuum bar is then pivoted about the pivot point to return the leading edge of the ready web to the first vacuum bar thereby creating an overlap of the leading edge and the adhesive tape on the first vacuum bar. Finally, the adhesive tape is adhered to a web positioning bar for transport to the splice head where the splice is made Preferably, the overlap of the leading edge and the adhesive tape is about 1 inch, and about 3 inches of adhesive tape remains exposed on the first vacuum bar.

BRIEF DESCRIPTION OF THE DRAWING

A preferred embodiment of the invention is described below with reference to the following figures wherein like numerals represent like parts.

DETAILED DESCRIPTION OF THE INVENTION

Figure 1:
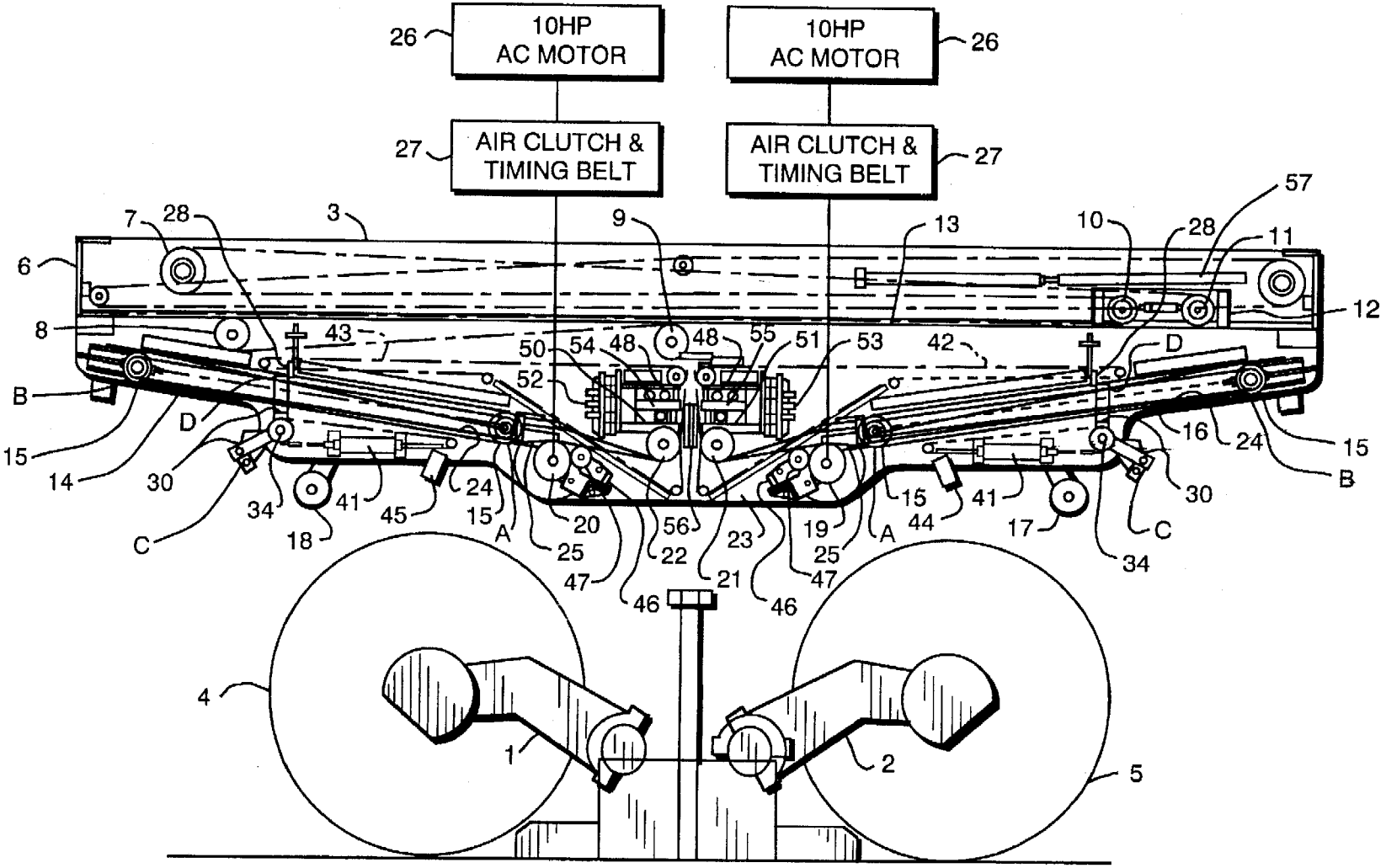
FIG. 1 is a front sectional view of a preferred embodiment of a web supply apparatus according to the present invention.
Figure 2:
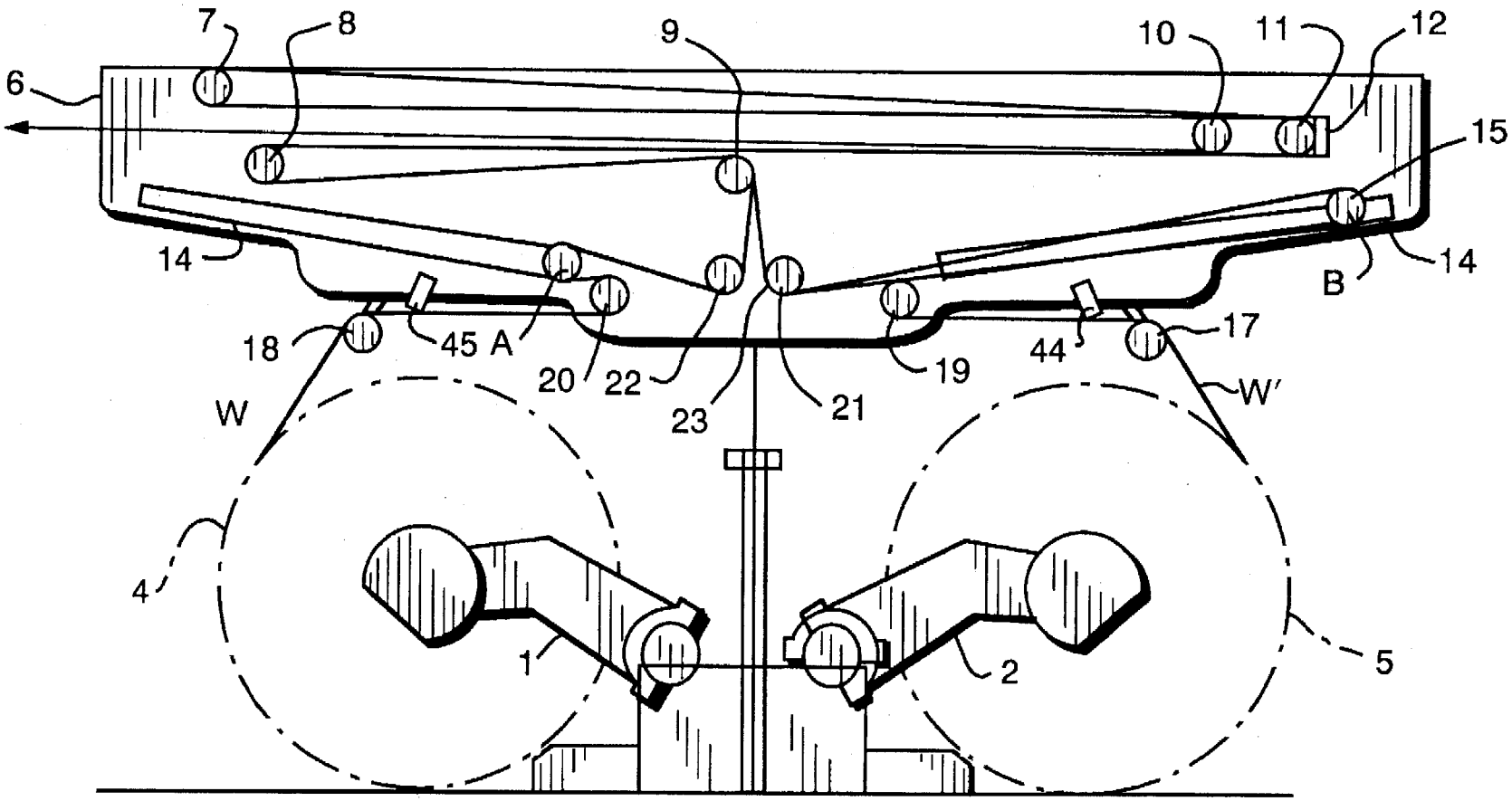
FIG. 2 is a front sectional view of a preferred embodiment of a web supply apparatus according to the present invention showing the threading of the running and ready webs through the input festoon, the splicer head, and the output festoon.

Refer now to FIG. 1 of the drawing which shows a web supply apparatus according to the present invention with roll stands 1, 2 of the fixed type which are well known. The apparatus is shown positioned under the bridge 3 of a conventional corrugator. One roll stand indicated at 1 supports a running roll 4 of running web W (FIG. 2). The other stand 2 supports a ready roll 5 of ready web W'. Basically, the purpose of the roll stands is to facilitate replenishing the web supply. When roll 4 expires, the web W is spliced to web W' and the apparatus draws on the web from roll 5. Then the core of the expired roll is removed from the roll stand 1 and replaced by a new roll of web.

Directly above the roll stands and suspended from bridge 3 is the output festoon indicated generally at 6. Output festoons of this general construction are well known and will not be detailed herein. Such a festoon is shown, for example, in U.S. Pat. No. 3,858,819.

A selected number, e.g. two, of idler rolls 7,8 are rotatively mounted on the festoon near the left-hand end thereof. Also, an idler roll 9 is rotatively mounted midway across the festoon 6. Additionally, dancer rolls 10,11 are rotatively and movably mounted on the festoon by means of a yoke 12 which carries the dancer rolls 10,11 arranged generally in a horizontal plane. Yoke 12 is movable toward and away from the idler rolls 7 and 8 along a suitable track 13.

According to the present invention, the web supply apparatus is further provided with two identical input festoons 14,16; one 14 associated with the running roll 4, and one 16 associated with the ready roll 5. Each input festoon preferably comprises a single dancer roll 15 which is slidably movable along a track between positions indicated at A and B. As will be discussed in detail below, the input festoons provide sufficient web storage capacity to allow the ready roll to be pre-accelerated to a running speed immediately upon splice initiation. This pre-acceleration of the ready roll obviates many of the disadvantages associated with prior art machines, and allows the web supply apparatus of the present invention to be operated at higher output speeds compared to the prior art.

As shown in FIG. 2, web from the running roll, i.e., roll 4, is fed to the festoon 6 by way of a splice head indicated generally at 23. The running web W is trained around input roll 18, and over an accelerator rolls 19,20. From the accelerator roll the web is trained over the dancer roll 15 in the input festoon 14 and then to the splice head rolls 22. From the splice head roll, the running web W proceeds past the idler roll 9, and then loops back and forth between the fixed rolls 7 and 8 and the movable dancer rolls 10,11, thereby forming a number of bights in the festoon. The leading edge of the ready web W' is trained in the same manner as the running web W over input roll 17, accelerator roll 19, dancer roll 15, splice head roll 21 and is positioned within the splice head for making a splice.

During normal operation, the yoke 12 is biased away from the fixed rolls 7,8 by an air cylinder so that it tends to assume a position near the right-hand side of the festoon as shown in FIGS. 1 and 2. Accordingly, the output festoon is able to store a relatively large supply of web, typically on the order of 60 feet or more. Upon leaving the festoon, the web W travels on into the web-consuming machine, i.e., a corrugator (not shown).

Figure 3:
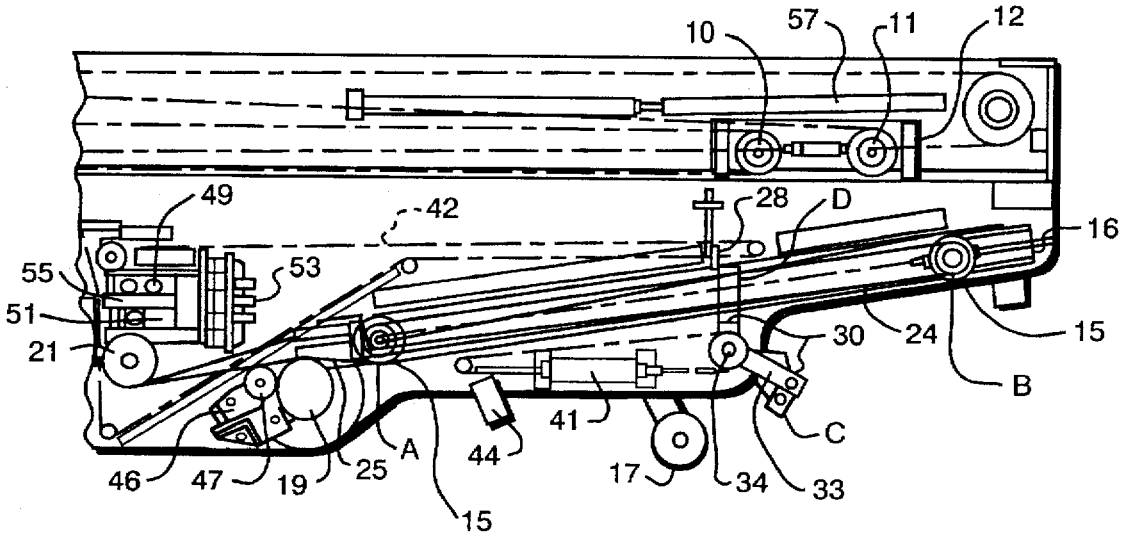
FIG. 3 is a detailed sectional view of the output festoon depicted in FIG. 1.

Turning now to FIG. 3, the operation of the input festoons 14, 16, will now be described in further detail. Although only one 16 of the input festoons is shown in FIG. 3, it is to be understood that each of the input festoons operate in the same manner.

FIG. 3 shows the single dancer roll 15 in its two extreme positions; A and B. The dancer roll 15, however, is movable along the length of a track 24, preferably under the force of an air piston 25. For a running web, the dancer roll remains at position A as shown for web W in FIG. 2. For the ready web, however, the position of the dancer roll depends upon whether or not the ready web is to be pre-accelerated. In the preferred embodiment, it has been determined that at output speeds of less than 750 f.p.m., the ready web can be sufficiently accelerated after initiation of a splice as in the prior art. However, as output speeds increase above 750 f.p.m., pre-acceleration of the ready web before creation of a splice becomes necessary since it becomes increasingly difficult to bring the ready web up to a running speed without breaking it before expiration of the stored web from the output festoon.

To facilitate pre-acceleration of the ready web, the dancer roll 15 moves from the position A toward the position B during pre-acceleration. This action provides for web storage in the input festoon 16 while the running and ready webs are stopped in the splice head 23 to make a splice. In the preferred embodiment shown in FIG. 3, the input festoon provides approximately 60" of web storage with the dancer roll 15 in position B. Thus, the ready web W' can be accelerated and stored progressively in the input festoon 16 while the leading edge of the ready web and the running web are completely stopped within the splice head 23 to form the splice.

Once the splice has been made, the dancer roll 15 falls back toward position A allowing the stored web to proceed through the splice head and fill the output festoon. All the while, the ready roll is being accelerated to a running speed. Ultimately, when the running speed is reached, the dancer roll 15 returns completely to position A, and the dancer roll yoke 12 returns to the far right-hand side of the output festoon.

To determine when the ready roll 15 is to be pre-accelerated, a computer control system (not shown) is provided. Preferably, when the output speed of the web supply apparatus is at or above 750 f.p.m. then the ready roll is pre-accelerated. Generally, if the output speed exceeds 1200 f.p.m. the ready roll is accelerated immediately upon indication to the control system that a splice is to be initiated. If, however, the output speed is between about 750 f.p.m. and 1200 f.p.m. it has been found that acceleration of the ready roll can be delayed slightly. Since a ready roll can vary between 10 lbs. at is core to about 8000 lbs., the preacceleration delay is determined by the computer system by calculating the weight of the ready roll from its diameter and width. From the weight of the ready roll, the computer system calculates the time at which the roll is to be accelerated and provides a signal to the drive system for the appropriate accelerator roll 19,20 to begin acceleration.

The drive system for accelerating the ready roll to a running speed preferably includes a 10 or more hp AC motor 26. One of these motors is coupled to each of the accelerator rolls 19,20 via an air clutch and a timing belt indicated at 27. The air clutch is preferably energized in a stepped fashion to provide progressively increased tension to the ready web. By using multiple steps to the clutch, the softest accelerating force is provided to the new web at the critical time right at the startup of the new roll. This avoids inadvertent breakage of a new roll due to rapid acceleration. Only when the roll is turning and the web is aligned, is the motor pulling with full force.

Once the splice has been made, and the ready web is operating at a running speed, the previous running roll is removed from the roll stand 1 and replaced by a new roll which becomes the source of a new ready web W'. At some time while the running web W is being consumed, the leading edge of web W' is adhered, to the positioning bar 28 with double-faced, pressure-sensitive tape preferably in a manner which facilitates the creation of a butt splice between the ready web and the running web.

Figure 4:
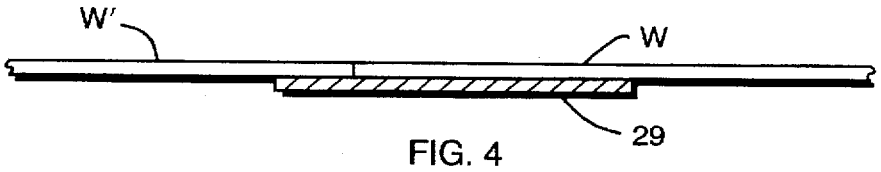
FIG. 4 is a side view of a butt splice made in accordance with the present invention.

As shown in FIG. 4, according to the present invention a butt splice between the ready web W' and the running web W is made with the double-faced adhesive tape 29 overlapping the ready web W' by about 1". In the preferred embodiment, a 4" width of adhesive tape 29 is provided, and the adhesive, therefore, overlaps the running web W by about 3" upon creation of the butt splice.

Figure 5A:
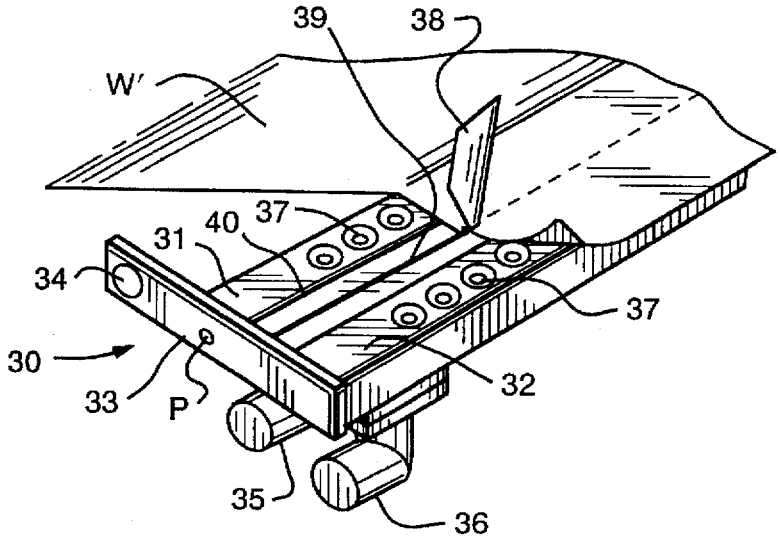
FIGS. 5A–5C: are consecutive views of a vacuum box showing the preparation for a butt splice according to the present invention.
Figure 5B:
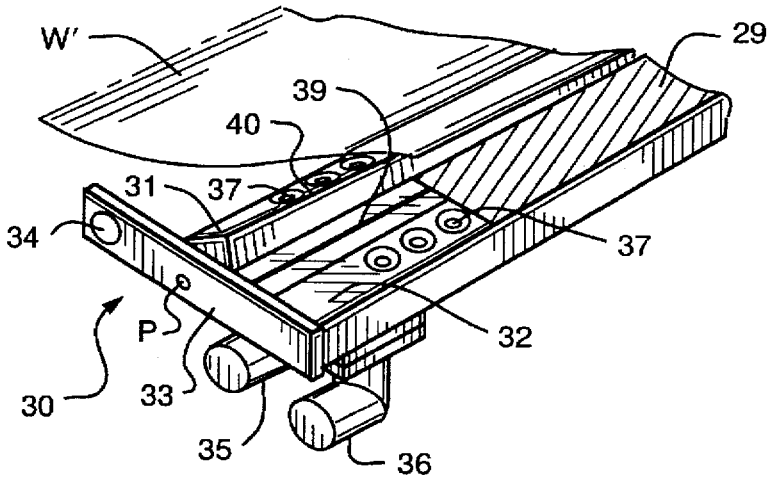
Figure 5C:
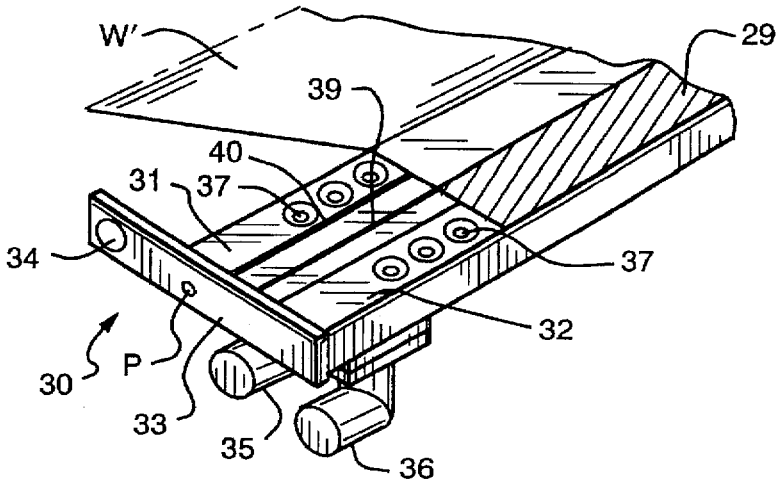

Turning now to FIGS. 5A–5C, the ready web W' is prepared for a splice as shown using a vacuum box 30 which is operatively connected to the web supply apparatus as shown in FIGS. 1 and 3. Referring to FIG. 5A, the vacuum box 30 includes two vacuum bars 31,32 mounted between two steel arms 33. For simplicity, only one end of the vacuum box is shown, it is to be understood, however, that the vacuum box extends across the width of the web supply apparatus so that an entire width of the ready web W' may be mounted thereon. Accordingly, on the other end of the vacuum box 30 the vacuum bars 31,32 are mounted in an identical fashion to a steel arm 33 so as to be fixed between two identical steel arms 33.

Each steel arm 33, includes a pivot bore 34 through which the vacuum box is pivotably mounted to the apparatus as shown in FIG. 3. Two vacuum hose connections 35,36 are provided underneath each vacuum bar. These hose connections are in communication with bores 37 in the upper face of the vacuum bars for providing a vacuum force to the ready web W' to hold it in position during operator preparation.

According to the present invention, one of the vacuum bars 31 is pivotably mounted to the steel arms 33 about a pivot point P. To prepare the ready web W' for a butt splice, the web is trained over the input roll 17 and around accelerator roll 19 as shown in FIG. 2. From the accelerator roll 19 the ready web W' is carried underneath the dancer roll 15 to the vacuum box 30 (FIG. 3).

As shown in FIG. 5A, to prepare the ready web for splicing the operator places the leading edge of the ready web W' over the vacuum box 30 and the web is held to the box by suction through bores 37. The operator then cuts the ready web W' by running a cutting instrument 38 through a slot 39 in the vacuum bar 30 at about 1" from its edge 40. The portion of the ready web held to the vacuum bar 32 is then removed.

Turning to FIG. 5B, the vacuum bar 31 is then pivoted about pivot point P so that the ready web W' separates from the vacuum bar 32. The double-faced pressure-sensitive adhesive tape 29 is then placed in line with the edge 40 of the vacuum bar 32. As shown in FIG. 5C, the vacuum bar 31 is then pivoted back to its original position causing the leading edge of the ready web to overlap the adhesive tape 29 by about 1" in the area between the slot 39 and the edge 40 of the vacuum bar 32. Approximately 3" of the adhesive tape 29 remains exposed on the vacuum bar 32.

Turning again to FIG. 3, once the ready web is prepared to the vacuum box 30 the vacuum box is pivoted upwardly, preferably under the force of an air piston 41, from its down position at point C to a position D. Upon reaching the position D the adhesive tape 29 is forced into contact with a web positioning bar 28 whereby it adheres to the positioning bar. The vacuum in the vacuum box 30 is thereafter turned off and the vacuum box is returned to position C while the adhesive tape 29 to which the ready web W' is attached remains fastened to the positioning bar 28.

The positioning bar is then transported to an appropriate position within the splice head 23 for creating a splice. Several means have been developed in the art for moving the positioning bar 28 into the splice head. In the preferred embodiment shown in FIGS. 1 and 3, the positioning bar 28 is moved to and from the splicing head by two endless chains 42,43 in a known manner. The web positioning bar associated with each roll 4,5 is moved in exactly the same way by the chains in assemblies 42.43. However, the positioning bars associated with each roll 4,5 are 180 degrees out of phase so that when the positioning bar associated with one of the rolls is in its ready position at the splice head 23, the positioning bar associated with the other roll is in its loading position, and vice-versa. Such a chain and gear transport system along with other transport systems which may be used in connection with the present invention are known in the art and are described, for example, in detail in U.S. Pat. No. 3,858,819.

In the present invention, the endless chains carry the positioning bar 28 and the ready web W' over the dancer roll 15 and then under the idler roll 21 and into the splice head. At this point a splice between the ready web W' and the running web W is ready to be made.

Advantageously, according to the present invention a splice may be initiated immediately on the occurrence of a web break on the running roll. This is accomplished by providing input rolls 17,18 around which the running web is trained, as shown in FIG. 2. These input rolls provide for about six feet of web between the input rolls 17,18 and the splicing head 23. This arrangement allows for tail grab sensors 44,45 to be positioned, as shown in FIGS. 1 and 2, within three inches of the running web.

When a web break occurs, the tail grab sensor 44 or 45 detects the break and provides a signal to a known control system to immediately initiate a splice. Using this arrangement, a splice can also be initiated when the running web expires from the running roll since the sensors will detect the trailing edge of the running web. As in prior art machines, a splice may also be initiated when the running roll reaches a predetermined minimum diameter.

Placing the sensors 44,45 close to the web eliminates problems associated with dust build up which can cause the sensors to malfunction. This ensures consistent tail grabbing at web speeds of up to 1000 f.p.m. Also, with the tail-grab sensors 44,45 mounted in an accessible position on the splicer, an operator has the opportunity to check the operation of the sensors before the actual splice takes place. This allows time for an operator to fix a problem that might develop in the sensor system, or at least time enough to realize that he would have to initiate a splice manually.

The first step in creating a splice requires immediate braking of the running roll 4. This is accomplished using a known braking system, such as disc brakes, which are automatically actuated through a known computer control system. At the same time, a nip trolley 46 is automatically actuated by the control system to cause a series of urethane nips 47 to pin the running web W against the accelerator roll 20 (in FIG. 2) over which the running web is trained. A series of independent nips 47 are mounted along the nip trolley 47 and are operably movable by an air cylinder (not shown) into and out of engagement with the accelerator rolls 19,20.

If the ready roll is to be pre-accelerated as discussed above, then, simultaneously with the initiation of the splice, the accelerator roll 19 is actuated to begin acceleration of the ready web W' into the input festoon 16 while the leading edge of the ready web W' is position at a stop within the splice head 23. The dancer roll 15 in the input festoon 16 then travels up the track 24 toward position B to progressively store the accelerating ready web while the splice is being made.

As soon as the running roll 4 stops, the leading edge of the ready web W' which has been prepared as aforesaid is bonded to the running web in the splicing head 23 and the running web W is severed just behind the splice. The mechanisms in the splice head for creating the splice and severing the web are substantially the same as those which are described in detail in U.S. Pat. No. 3,858,819.

Briefly, the splice head 23 comprises a pair of upper nip bars 48,49 and lower nip bars 50,51 which are independently movable under the action of air diaphragms at 52,53. Between the upper and lower nip bars are independently movable knife assemblies 54,55 with long knife blades. Once the running web W is stopped, the upper nip bars 48,49 are forced together thereby forcing nip bar 48 against a positioning bar 28 adjacent the nip bar 49. As described previously, fixed to the positioning bar 28 is the leading edge of the ready roll with 3" wide adhesive tape exposed to a side adjacent the running web which is at rest adjacent the nip bar 48. The leading edge of ready web is, therefore forced against the running web thereby creating a 4" butt splice combining the two webs.

At the same time that the splice is made, the lower nip bar 50 in FIG. 1 adjacent the running web is forced against the knife backup bar 56 thereby pinning the running web W. Immediately thereafter, the knife assembly 54 nearest the running web is driven in the direction of the running web thereby completely and quickly severing the running web above the knife backup bar 56. Once the splice is made and the web is cut, the upper and lower nips are returned to their original positions out of the way of the running web.

Turning again to FIGS. 1 and 2, at the same time that the running web is stopped, the dancer rolls 10,11 must move in the direction of the idler rolls 7,8 to allow the stored web to travel into the web consuming machine. In the preferred embodiment, an air piston 57 operating via compressed air moves the dancer yoke 12 forward without any increase of web tension. This allows the running web in the festoon to supply the web-consuming apparatus during the splicing operation as if the running roll had never stopped.

Once the splice is complete, the dancer roll 15 in the input festoon falls back toward position A allowing the ready web W' stored in the input festoon 16 to begin traveling through the splice head 23 to the output festoon 6. As the ready web approaches its running speed, the dancer roll 15 returns to position A, and the output festoon 6 receives more web than it loses and the yoke 12 resumes its normal position near the right-hand end of the festoon, thereby completing the splice cycle.

As is known in the art, the entire system may be operated and controlled via an appropriate computer for accessing sensor signals and providing control signals to known controllers for controlling the splicing and pre-accelerating operations. Preferred controllers for the system are typically commercial ALLEN BRADLEY or SIEMENS programmable controllers which can be adapted for operation with a system as herein described, as is well known to those skilled in the art.

Thus, according to the present invention there is provided web supply apparatus which is capable of reliably affecting a high speed splice between a running web and a ready web. The apparatus performs this function using input festooning to allow pre-acceleration of the ready roll to a running speed thereby obviating the disadvantages associated with accelerating a ready roll after a splice is made. In connection with the input festooning, the present invention further provides a web supply apparatus which is capable of providing an accurate high-speed butt splice under both "tail grab" and predetermined conditions. The embodiments which have been described herein, however, are but some of the several which utilize this invention and are set forth here by way of illustration but not of limitation. It is obvious that many other embodiments which will be readily apparent to those skilled in the art may be made without departing materially from the spirit and scope of this invention.

What is claimed is:

1. A method of preparing a ready web for creating a high speed butt splice using a web supply apparatus wherein the web supply apparatus comprises a first source of web; a second source of web; a splice head for creating a splice between a running web on said first source of web and a ready web on said second source of web; and an input festoon for storing an amount of ready web sourced from said second source of web while said splice is being created in said splice head; and a vacuum box for preparing said ready web for splicing, said vacuum box comprising a first vacuum bar adjacent a second vacuum bar, said first and second vacuum bars being adapted to provide suction to hold said ready web to said vacuum box, said first vacuum bar including a lengthwise slot into which a cutting instrument is placed to sever said ready web in line with said slot to create a leading edge on a portion of said first vacuum bar, said second vacuum bar being pivotable about a pivot point to separate said leading edge from said first vacuum bar, and said second vacuum bar being further pivotable about said pivot point to return said leading edge onto said first vacuum bar said method comprising:

placing said ready web on said first and said second vacuum bars;

cutting said ready web in line with said slot to create said leading edge on a portion of said first vacuum bar;

pivoting said second vacuum bar about said pivot point to remove said leading edge from said first vacuum bar;

placing an adhesive tape on said first vacuum bar;

pivoting said second vacuum bar about said pivot point to return said leading edge to said first vacuum bar thereby creating an overlap of said leading edge and said adhesive tape on said first vacuum bar; and adhering said adhesive tape to a web position bar for transport to said splice head.

2. A method according to claim 1, wherein said overlap of said leading edge and said adhesive tape is about 1 inch.

3. A method according to claim 2, wherein said about 3 inches said adhesive tape is not overlapped by said leading edge.

4. A web supply apparatus comprising:

a first source of web;

a second source of web;

a splice head for creating a splice between a running web on said first source of web and a ready web on said second source of web;

a vacuum box including a first vacuum bar adjacent a second vacuum bar, said vacuum bars being adapted to provide suction to hold said ready web to said vacuum box, said first vacuum bar having a slot formed therein, a cutting instrument insertable in said slot to sever said ready web to form a leading edge on said first vacuum bar, said second vacuum bar being pivotable about a point to separate said leading edge from said first vacuum bar and further pivotable about said point to return said leading edge to said first vacuum bar; and an input festoon for storing an amount of ready web sourced from said second source of web while said splice is being created in said splice head, said input festoon thereby allowing said second source of web to be pre-accelerated to a running speed before said splice is made.

* * * * *